US010508410B2

(12) United States Patent
Hoshaku et al.

(10) Patent No.: US 10,508,410 B2
(45) Date of Patent: Dec. 17, 2019

(54) AUTOMATIC VIBRATION DEVICE OF WORK MACHINE

(71) Applicant: Caterpillar SARL, Geneva (CH)

(72) Inventors: Shota Hoshaku, Tokyo (JP); Koichi Murata, Tokyo (JP); Masashi Shibata, Hyogo (JP)

(73) Assignee: Caterpillar SARL, Geneva (CH)

( * ) Notice: Subject to any disclaimer, the term of this patent is extended or adjusted under 35 U.S.C. 154(b) by 0 days.

(21) Appl. No.: 15/573,426

(22) PCT Filed: May 3, 2016

(86) PCT No.: PCT/EP2016/059924
§ 371 (c)(1),
(2) Date: Nov. 10, 2017

(87) PCT Pub. No.: WO2016/180686
PCT Pub. Date: Nov. 17, 2016

(65) Prior Publication Data

US 2018/0135274 A1 May 17, 2018

(30) Foreign Application Priority Data

May 11, 2015 (JP) ..... 2015-096591

(51) Int. Cl.
*E02F 3/43* (2006.01)
*E02F 9/22* (2006.01)

(52) U.S. Cl.
CPC ..... *E02F 3/437* (2013.01); *E02F 9/221* (2013.01)

(58) Field of Classification Search
CPC ..... E02F 3/405; E02F 9/221
USPC ..... 37/904; 172/40
See application file for complete search history.

(56) References Cited

U.S. PATENT DOCUMENTS 4,377,043 A * 3/1983 Inui ..... E02F 3/439 37/414
4,677,579 A * 6/1987 Radomilovich ..... E02F 9/26 177/147
4,809,794 A * 3/1989 Blair ..... E02F 3/30 177/139
5,172,498 A * 12/1992 Wack ..... E02F 3/405 171/132
5,224,033 A * 6/1993 Nakamura ..... E02F 3/438 172/2
5,235,809 A * 8/1993 Farrell ..... E02F 9/221 60/445

(Continued)

FOREIGN PATENT DOCUMENTS

JP 02-304124 A 12/1990
JP 05263441 10/1993

(Continued)

*Primary Examiner* — Gary S Hartmann

(57) ABSTRACT

An automatic swing device for a work machine is capable of performing a sieve operation in the posture where a work device is always at a posture suitable for sieve operation. An automatic swing device includes a posture sensor that detects a posture of a work device, and a controller that outputs signals to operate at least a stick cylinder and a bucket cylinder of the work device. The controller has an automatic swing mode in which the work device is automatically swung while the posture detected by the posture sensor is maintained to be in the range of a predetermined posture.

8 Claims, 5 Drawing Sheets

(56) References Cited

U.S. PATENT DOCUMENTS

| | | | | |
|---|---|---|---|---|
| 5,287,699 | A | 2/1994 | Takamura et al. | |
| 5,794,369 | A * | 8/1998 | Lee | E02F 3/437 37/348 |
| 5,860,231 | A * | 1/1999 | Lee | E02F 9/2025 172/2 |
| 6,053,629 | A * | 4/2000 | Nakashima | E02F 9/221 366/124 |
| 6,725,105 | B2 * | 4/2004 | Francis | E02F 3/405 318/592 |
| 7,062,350 | B2 * | 6/2006 | Peterson | E02F 3/405 172/40 |
| 7,269,943 | B2 * | 9/2007 | Buckmier | E02F 9/221 60/327 |
| 7,571,604 | B2 * | 8/2009 | Vigholm | E02F 9/2203 60/445 |
| 7,669,354 | B2 * | 3/2010 | Aebischer | E02F 9/264 37/348 |
| 9,051,718 | B2 * | 6/2015 | Schmidt | E02F 3/325 |
| 10,246,855 | B2 * | 4/2019 | Greer | E02F 9/221 |
| 2009/0031891 | A1 | 2/2009 | Brinkman et al. | |
| 2010/0256837 | A1 | 10/2010 | Schmidt | |
| 2015/0134209 | A1 * | 5/2015 | Lee | E02F 3/437 701/50 |

FOREIGN PATENT DOCUMENTS

| | | | |
|---|---|---|---|
| JP | 08135204 | | 5/1996 |
| JP | 09-291566 | A | 11/1997 |
| JP | 2000301069 | | 10/2000 |
| JP | 2001288711 | | 10/2001 |
| JP | 2010089633 | | 4/2010 |
| WO | 2005/093170 | A1 | 10/2005 |

* cited by examiner (a)

(b)

AUTOMATIC VIBRATION DEVICE OF WORK MACHINE

CROSS-REFERENCE TO RELATED APPLICATIONS

This application is a national phase application of International Patent Application No. PCT/EP2016/059924 filed May 3, 2016, which claims priority to Japanese Patent Application No. 2015-096591 filed May 11, 2015, both of which are incorporated by reference herein in their entireties for all purposes.

TECHNICAL FIELD

The present invention relates to an automatic vibration device for a work machine, the automatic vibration device causing a work device to vibrate automatically.

BACKGROUND ART

The applications of a work machine, such a hydraulic shovel, include sieving where the stick-in/out operations and the bucket-in/out operations are repeated in order to remove dirt and gravel from the scooped load using a skeleton bucket or to scatter the load on the ground.

In the past, an operator has manually operated an operation lever in order to execute this type of sieving. In recent years, however, there has been known a work machine that automates the sieving in which a work device is vibrated automatically by causing a controller to simulate the signals input from the operation lever.

According to the known configuration, not only is it possible to independently set the positive and negative vibration amplitudes of a work device, but also the center between the positive vibration amplitude and the negative vibration amplitude is made variable by a manual operation.

According to another known configuration, the vibrations and the number of vibration amplitudes of a work device can be changed by using the operator's operation of an operation lever as a trigger.

SUMMARY OF INVENTION

Unfortunately, the known configurations each have a risk that the load might spill out of the bucket due to the vibration amplitudes or as a result of the center between the amplitudes being shifted from the starting position, making it difficult to execute sieving properly.

In addition, repeatedly using a set amplitude also makes it difficult to execute, sieving at an appropriate amplitude and speed in response to the condition of the load in the bucket.

The present invention was contrived in view of these circumstances, and an object thereof is to provide an automatic vibration device of a work machine that is capable of causing a work machine to automatically vibrate constantly in a posture suitable for the automatic vibration.

Solution to Problem

According to an aspect of the disclosure, an automatic vibration device for a work machine has: a chassis; a work device that has a stick rotated by a stick cylinder and a bucket coupled axially to a tip of the stick and rotated by a bucket cylinder and that is axially coupled to the chassis so as to be operated; a posture sensor that detects a posture of the work device; and a controller that outputs a signal for operating at least the stick cylinder and the bucket cylinder, wherein the controller has an automatic vibration mode for causing the work device to vibrate automatically while keeping the posture, which is detected by the posture sensor, within a predetermined posture range.

According to another aspect of the disclosure, the automatic vibration device for a work machine further has a weight sensor that detects a weight of a load scooped into the bucket, wherein the controller, in the automatic vibration mode, variably sets an amplitude of the automatic vibration of the work device in accordance with the weight of the load detected by the weight sensor.

Advantageous Effects of Invention

With the posture sensor for detecting the posture of the work device, an aspect of the present disclosure can cause the work device to vibrate automatically, while feeding back the position of the work device. Thus, the work device can automatically be vibrated constantly in the posture suitable for the automatic vibration.

With the weight sensor for detecting the weight of the load scooped into the bucket, an aspect of the present disclosure can feed back the weight of the load to change the automatic vibration of the work device in accordance with the weight of the load.

DESCRIPTION OF EMBODIMENTS

The present invention is described hereinafter in detail based on an embodiment shown in FIGS. 1 to 8.

Figure 2:
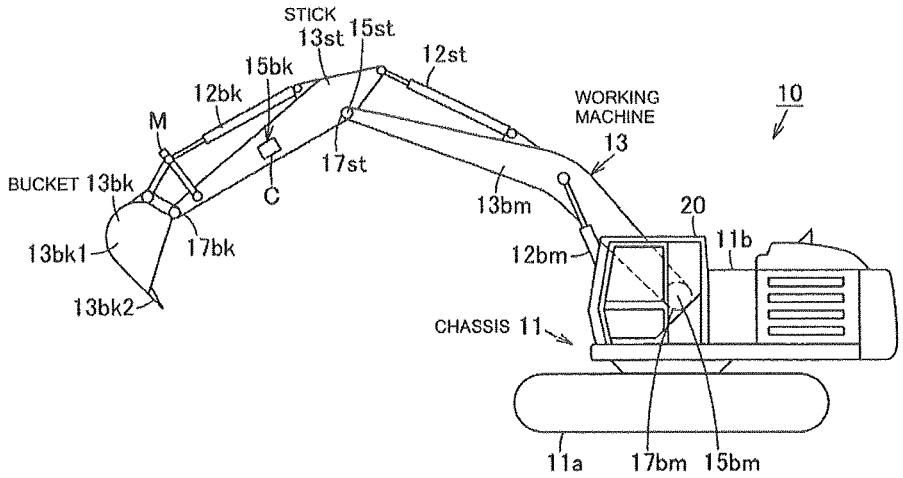
FIG. 2 is a side view showing the work machine.

FIG. 2 shows a work machine 10 as a hydraulic shovel. In this work machine 10, a work device 13 that is moved up and down by a boom cylinder 12*bm* functioning as a fluid pressure cylinder (hydraulic cylinder) is mounted onto a chassis 11 having an upper revolving body 11*b* disposed revolvable with respect to a lower traveling body 11*a*.

In the work device 13, a base end of a boom 13*bm* is axially supported by the upper revolving body 11*b* so as to be able to rotate in a vertical direction, a stick 13*st* is axially supported at a tip of the boom 13*bm* so as to be rotatable, and a bucket 13*bk* is axially supported at a tip of the stick 13*st* so as to be rotatable. The boom 13*mb* is rotated by the boom cylinder 12*bm*, the stick 13*st* is rotated by a stick cylinder 12*st* functioning as a fluid pressure cylinder (hydraulic cylinder), and the bucket 13*bk* is rotated by a bucket cylinder 12*bk* functioning as a fluid pressure cylinder (hydraulic cylinder).

Sensors 15*bm*, 15*st*, 15*bk* functioning as boom posture detection means, stick posture detection means, and bucket posture detection means for detecting the postures of the boom 13*bm*, the stick 13*st*, and the bucket 13*bk* respectively are attached to the work device 13, as well as a weight sensor 16 for detecting the weight of the load (payload) scooped into the bucket 13*bk*. These sensors 15*bm*, 15*st*, 15*bk* configure a posture sensor 15 for detecting the posture of the work device 13. In other words, the posture sensor 15 detects the angles (positions) of the boom 13*bm*, the stick 13*st*, and the bucket 13*bk* of the work device 13.

An angle sensor that is also called "potentiometer," a position sensor for detecting a position, and the like can randomly be used as the sensors 15*bm*, 15*st*, 15*bk*. In the present embodiment, however, angle sensors are used as, for example, the sensors 15*bm*, 15*st*, and a position sensor is used as the sensor 15*bk*.

The sensor 15*bm* is attached to, for example, a boom foot pin 17*bm* that axially supports the boom 13*bm* on the chassis 11 (the upper revolving body 11*b*).

The sensor 15*st* is attached to, for example, a pivot pin 17*st* that axially supports the base end side of the stick 13*st* with respect to the tip side of the boom 13*bm* (stick base end side).

The sensor 15*bk* detects a telescopic motion of the bucket cylinder 12*bk* by causing a detector main body (laser catcher) C attached to the side of the stick 13*st* to detect the position of a marker M attached to a rod of the bucket cylinder 12*bk*. In this manner, the sensor 15*bk* detects the position (rotation angle) of the bucket 13*bk* with respect to the stick 13*st*.

In the present embodiment, absolute angles can be detected as the rotation angles detected by the sensors 15*bm*, 15*st*, 15*bk*, by mounting, for example, a body tilt sensor. However, relative angles of the boom 13*bm*, the stick 13*st*, and the bucket 13*bk* with respect to the chassis 11, the boom 13*bm*, and the stick 13*st* may be detected.

The weight sensor 16 can be configured in any form. For instance, based on the postures of the boom 13*bm* and the stick 13*st* detected by the sensors 15*bm*, 15*st* and pressure sensors 16*bmh*, 16*bmr* for detecting head-side and rod-side pressures of the boom cylinder 12*bm*, the weight sensor 16 calculates the balance of moment to compute the weight of the load in the bucket 13*bk*.

The bucket 13*bk* integrally has, for example, a bucket main body 13*bk*1 that is in the shape of a container for containing the load, and a tooth tip 13*bk*2 protruding to a tip of the bucket main body 13*bk*1. A so-called skeleton bucket in which the bucket main body 13*bk*1 has lattice-like openings (not shown) is used as the bucket 13*bk* when executing sieving in, for example, an automatic vibration mode, which is described hereinafter.

Figure 3:
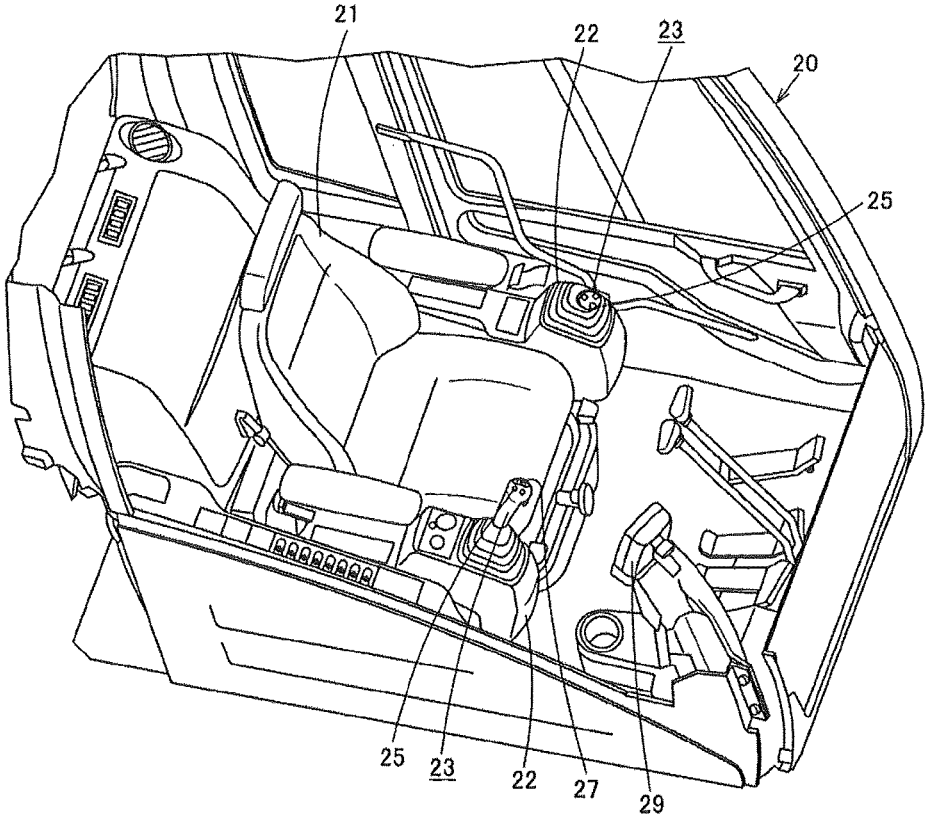
FIG. 3 is a perspective view showing the inside of a cab of the work machine.

A cab 20 for protecting a workspace of an operator is mounted on one side of the upper revolving body 11*b*. As shown in FIG. 3, inside the cab 20 are operation levers 23, 23, operation units that are provided on consoles 22, 22 located on either side of a driver's seat 21. As selector switches, a switch 25 in the form of a push button and a thumbwheel switch 27 are provided on these operation levers 23, 23. In addition, a monitor 29 functioning as input means and display means is installed in the cab 20.

The switch 25 in the form of a push button and the thumbwheel switch 27 are located in a front part on each operation lever 23. Either one of these switches 25, 27 is used as a selector switch for the automatic vibration mode in which the work device 13 is vibrated automatically to execute sieving. When either one of the switches 25, 27 is turned ON to switch to the automatic vibration mode from a normal mode in which the work device 13 is operated using the operation levers 23 without performing automatic vibration, the work machine 13 enters a standby state, and by turning either one of the switches 25, 27 ON again in this standby state, automatic vibration of the work device 13 is started. When either one of the switches 25, 27 is turned ON during the automatic vibration, the automatic vibration mode is ended and the normal mode begins. When the work device 13 is in the automatic vibration mode, the automatic vibration mode is displayed on the monitor 29.

Figure 1:
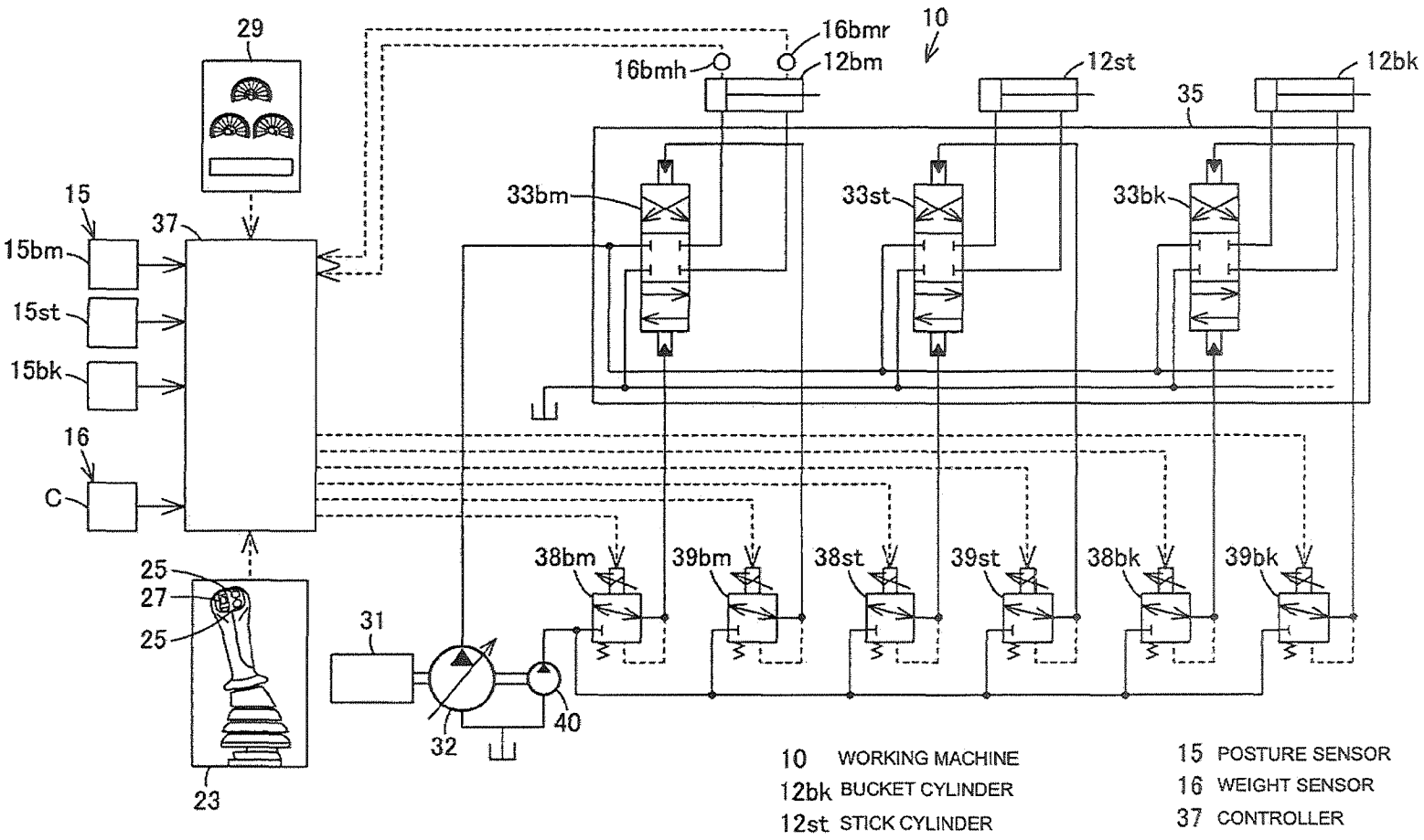
FIG. 1 is a schematic diagram showing an embodiment of an automatic vibration device for a work machine according to the present invention.

FIG. 1 shows an outline of a control circuit for controlling the work device 13. Inside a block 35 are spools 33*bm*, 33*st*, 33*bk* that are provided in a movable manner. The spools 33*bm*, 33*st*, 33*bk* function as control valves for controlling hydraulic oil, a working fluid that is supplied from a main pump 32 driven by an in-vehicle engine 31 to the cylinders 12*bm*, 12*st*, 12*bk*. In addition to these spools, the block 35 also has a traveling motor control spool, a swing motor control spool and the like are provided in a movable manner, but the explanations thereof are omitted herein for the purpose of clarification.

The boom cylinder 12*bm* is a single rod type hydraulic cylinder for operating the work device 13 in the vertical direction. By operating the operation levers 23, the boom cylinder 12*bm* is elongated to lift the work device 13 (the boom 13*bm*) with respect to the chassis 11 (the upper revolving body 11*b*) (boom lifting operation) and contracted to lower the work device 13 (the boom 13*bm*) with respect to the chassis 11 (the upper revolving body 11*b*) (boom lowering operation).

The stick cylinder 12*st* is a single rod type hydraulic cylinder for operating the stick 13*st* in a front-back direction with respect to the boom 13*bm*. By operating the operation levers 23, the stick cylinder 12*st* is elongated to operate the stick 13*st* forward with respect to the boom 13*bm* or, in other words, moved away from the operator (stick-out operation), and contracted to operate the stick 13*st* backward with respect to the boom 13*bm* or, in other words, brought close to the operator (stick-in operation).

The bucket cylinder 12*bk* is a single rod type hydraulic cylinder for operating the bucket 13*bk* in the front-back direction with respect to the stick 13*st*. By operating the operation levers 23, the bucket cylinder 12*bk* is elongated to operate the bucket 13*bk* forward with respect to the stick 13*st* (bucket-out operation) and contracted to operate the bucket 13*bk* backward with respect to the stick 13*st* (bucket-in operation).

The operation levers 23 are connected to an input unit of a controller (electronic control module ECM) 37. The input unit of the controller 37 is also connected to the sensor 15 (sensors 15*bm*, 15*st*, 15*bk*), weight sensor 16 (pressure sensors 16*bmh*, 16*bmr*), monitor 29 and the like. An output unit of the controller 37 is connected to the solenoids of solenoid proportional valves 38*bm*, 39*bm*, 38*st*, 39*st*, 38*bk*, 39*bk*.

The solenoid proportional valves 38*bm*, 39*bm*, 38*st*, 39*st*, 38*bk*, 39*bk* are pressure-reducing valves that convert pilot primary pressure, which is supplied from a pilot pump 40, into pilot secondary pressure corresponding to a control signal input from the controller 37, and then apply the pressure to a pilot pressure application unit of each of the spools 33*bm*, 33*st*, 33*bk*.

The controller 37 is electrically connected to the posture sensor 15 (sensors 15*bk*, 15*bm*, 15*st*), weight sensor 16, operation levers 23 (switches 25, 27), and solenoid proportional valves 38*bm*, 39*bm*, 38*st*, 39*st*, 38*bk*, 39*bk*, and outputs electrical signals for operating (elongating and contracting) the cylinders 12*bm*, 12*st*, 12*bk*. The controller 37 not only functions to switch between the normal mode and the automatic vibration mode through operation of either one of the switches 25, 27, wherein in the automatic vibration mode, the controller 37 generates an electrical signal for automatically vibrating the work device 13 while keeping the posture of the work device 13 detected by the posture sensor 15 within a predetermined posture range, but also functions to variably set the amplitude of the automatic vibration in accordance with the weight of the load detected by the weight sensor 16. The controller 37 may also have any other modes in addition to the normal mode and automatic vibration mode. The controller 37 may also electrically detect the pilot secondary pressure converted by the solenoid proportional valves 38*bm*, 39*bm*, 38*st*, 39*st*, 38*bk*, 39*bk*.

A control procedure corresponding to the automatic vibration mode is described next.

Generally, in the automatic vibration mode, the work machine 10 first enters an automatic vibration standby state where the work device 13 is in a predetermined preparation posture (ideal posture). The preparation posture is a posture where, as shown by the solid lines in FIGS. 4(*a*) and 4(*b*), the boom 13*bm* is lowered to a predetermined position where the bucket 13*bk* is not grounded, while the stick 13*st* is substantially perpendicular (the pivot pins 17*st*, 17*bk* are aligned vertically in a perpendicular direction) and the position of the tooth chip 13*bk*2 of the bucket 13*bk* is substantially parallel to the pivot pin 17*bk*. When an instruction to start automatic vibration from the standby state is input, automatic vibration is performed selectively in a first automatic vibration mode or a second vibration mode at the amplitude corresponding to the weight of the load scooped into the bucket 13*bk*, in such a manner that the posture of the work device 13 falls within the predetermined posture range (within a first posture range R1 or a second posture range R2), i.e., until a stop instruction (end instruction) is input while occasionally making adjustments to keep a predetermined vibration center.

Figure 4:
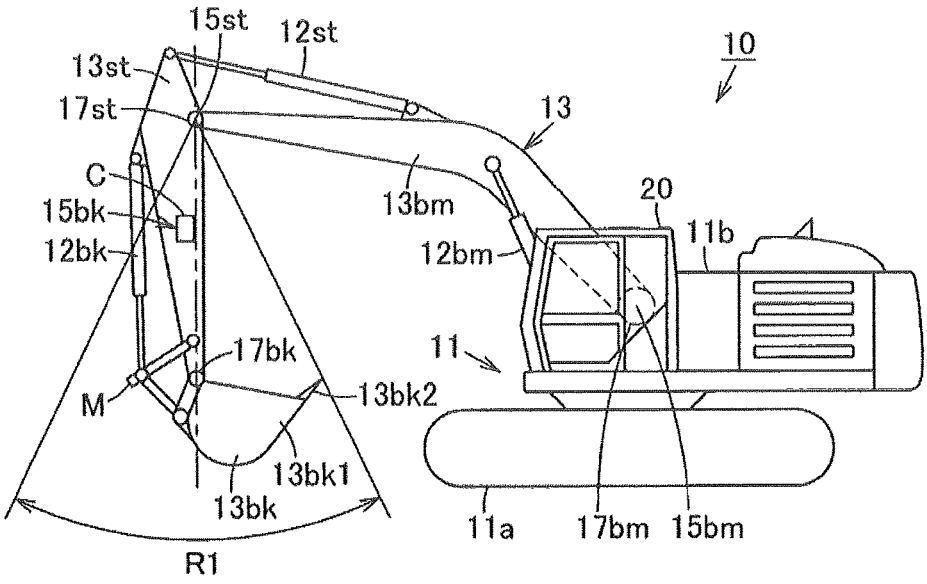
FIG. 4(*a*) is a side view showing a vibration in a first automatic vibration mode, and FIG. 4(*b*) is a side view showing a vibration in a second automatic vibration mode.
Figure 4:
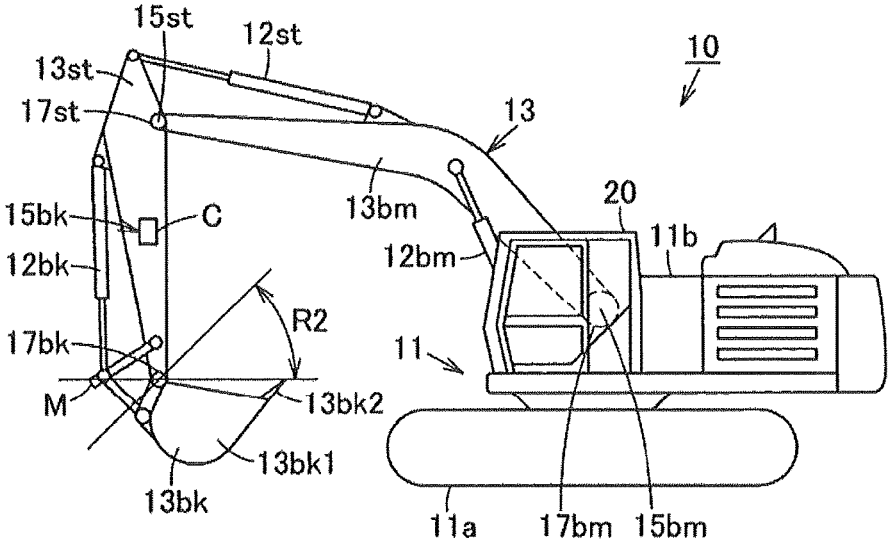

Stick sieving is executed in the first automatic vibration mode shown in FIG. 4(*a*) by alternately repeating the stick-in operation and the stick-out operation from the preparation posture, in order to, for example, scatter some of the load over a wide range. Bucket sieving is executed in the second automatic vibration mode shown in FIG. 4(*b*) by alternately repeating the bucket-in operation and the bucket-out operation from the preparation posture, in order to, for example, sift the load by dumping dirt and other extraneous matters adhered to the load. The operator can randomly select the first automatic vibration mode or the second automatic vibration mode as needed, by operating the switches 25, 27 (FIG. 1).

The first posture range (first ideal range) R1 corresponding to the first automatic vibration mode (FIG. 4(*a*)) is a range where the stick 13*st* (virtual line connecting the pivot pins 17*st*, 17*bk*) is positioned at predetermined angles in the front-back direction with respect to the foregoing preparation posture.

The second posture range (second ideal range) R2 corresponding to the second automatic vibration mode (FIG. 4(*b*)) is a range where the position of the tooth chip 13*bk*2 of the bucket 13*bk* is higher than the pivot pin 17*bk* with respect to the foregoing preparation posture.

Figure 5:
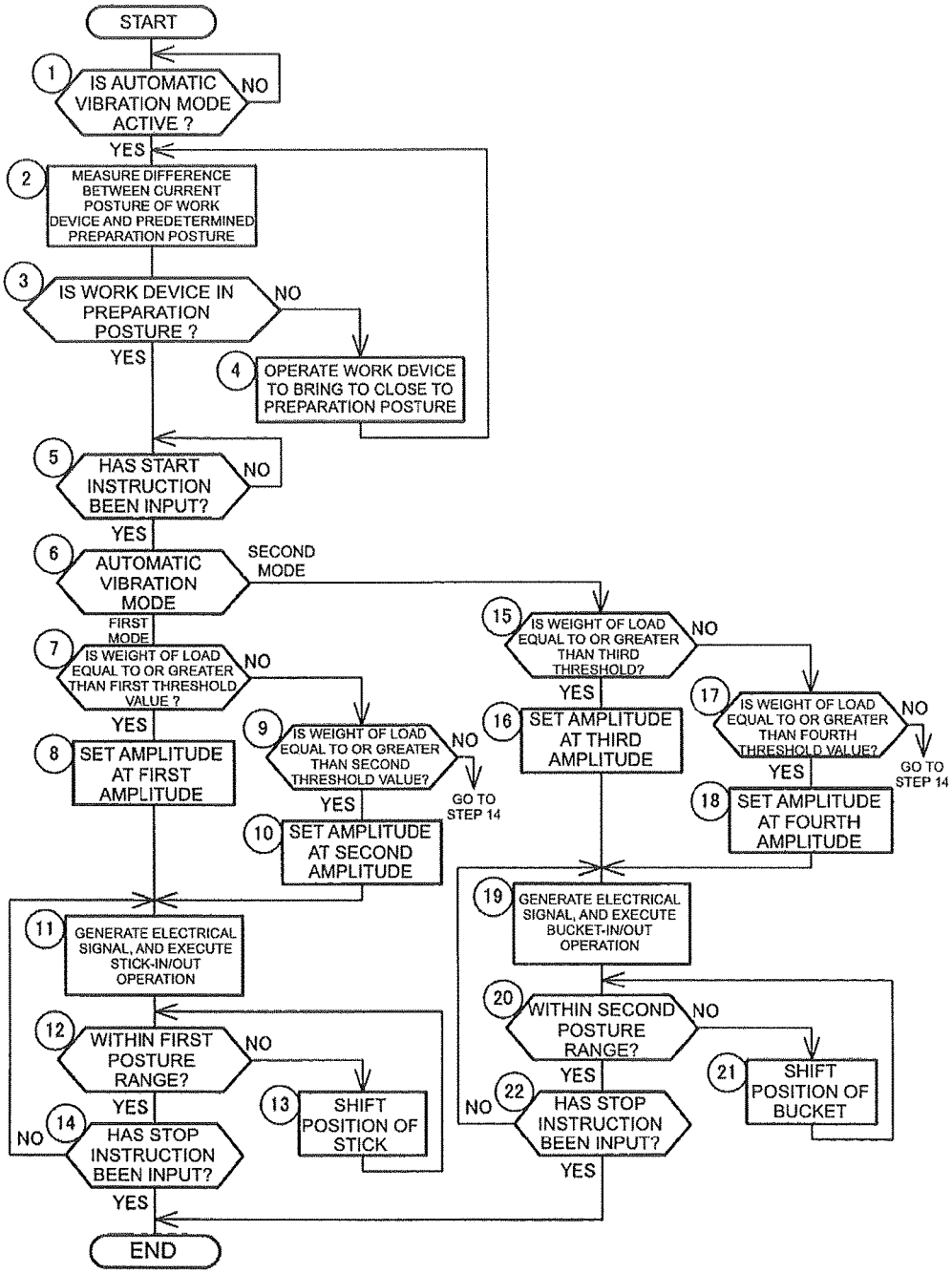
FIG. 5 is a flowchart showing a control procedure corresponding to an automatic vibration mode of the automatic vibration device.
Figure 6:
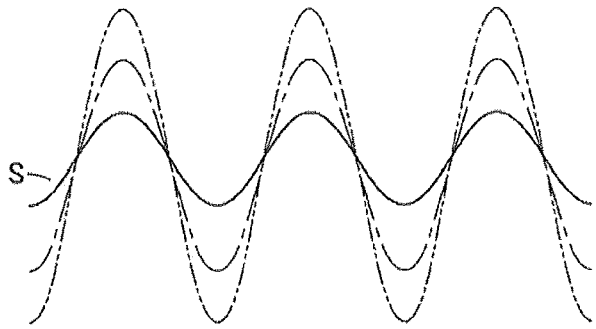
FIG. 6 is an explanatory diagram showing an electrical signal for setting a vibration amplitude of a work device, the electrical signal being generated by a controller in the automatic vibration mode.

The foregoing control procedure is now described in detail with reference to the flowchart shown in FIG. 5 as well. The numbers in the circles shown in FIG. 5 represent the step numbers.

(Step 1)

The controller 37 determines whether the automatic vibration mode is effective or not. When the automatic vibration mode is not effective (ineffective), step 1 is repeated. When the automatic vibration mode is effective, the procedure proceeds to step 2.

(Step 2)

The controller 37 causes the posture sensor 15 to measure the current positions of the boom 13*bm*, stick 13*st* and bucket 13*bk*, i.e., the current posture of the work device 13, and measures the difference between this value obtained by the posture sensor 15 and a value corresponding to the predetermined preparation posture that is stored beforehand.

(Step 3)

The controller 37 determines whether the work device 13 is in the preparation posture or not, based on whether the difference measured in step 2 falls within a predetermined range. When it is determined that the work device 13 is not in the preparation posture, the procedure proceeds to step 4. When it is determined that the work device 13 is in the preparation posture, the procedure proceeds to step 5.

(Step 4)

The controller 37 outputs, to the solenoid proportional valves 38*bm*, 39*bm*, 38*st*, 39*st*, 38*bk*, 39*bk*, a signal for elongating/contracting at least one of the cylinders 12*bm*, 12*st*, 12*bk* by a predetermined amount if needed, to operate the work device 13, in such a manner that the difference between the value obtained by the posture sensor 15 and the value corresponding to the predetermined preparation posture stored beforehand becomes small, i.e., in such a manner as to bring the posture of the work device 13 close to the preparation posture. The procedure is then returned to step 2.

(Step 5)

The controller 37 determines whether or not an instruction to start automatic vibration is input through the operation of either one of the switches 25, 27. When it is determined that the instruction to start automatic vibration is not input, step 5 is repeated. When it is determined that the instruction to start automatic vibration is input, the procedure proceeds to step 6.

(Step 6)

The controller 37 determines whether the set mode is the first automatic vibration mode or the second automatic vibration mode. When it is determined that the set mode is the first automatic vibration mode, the procedure proceeds to step 7. When it is determined that the set mode is the second automatic vibration mode, the procedure proceeds to step 15.

(Step 7)

The controller 37 compares the weight of the load measured by the weight sensor 16 with a first threshold value stored beforehand. When the weight of the load is equal to or greater than the first threshold value, the procedure proceeds to step 8. When the weight of the load is less than the first threshold value, the procedure proceeds to step 9.

(Step 8)

The controller 37 sets the amplitude of the automatic vibration at a predetermined, large first amplitude, and moves the procedure to step 11.

(Step 9)

The controller 37 compares the weight of the load measured by the weight sensor 16 with a second threshold value stored beforehand, which is smaller than the first threshold value. When it is determined that the weight of the load is equal to or greater than the second threshold value, the procedure proceeds to step 10. When it is determined that the weight of the load is less than the second threshold value, the automatic vibration mode is ended.

(Step 10)

The controller 37 sets the amplitude of the automatic vibration at a predetermined, small second amplitude that is smaller than the first amplitude set in step 8, and then moves the procedure to step 11.

(Step 11)

The controller 37 generates an electrical signal S (e.g., FIG. 6), which simulates an electrical signal generated by the operator operating the operation levers 23 when repeatedly executing the stick-in/out operation, outputs the electrical signal S to the solenoid proportional valves 38*st*, 39*st*, and thereby executes the stick-in/out operation at the amplitude set in step 8 or step 10. Accordingly, the first automatic vibration mode is executed.

(Step 12)

The controller 37 measures the positions of the boom 13*bm*, the stick 13*st*, and the bucket 13*bk* by means of the posture sensor 15, and determines whether the values obtained by the posture sensor 15 fall within a predetermined first value range corresponding to the predetermined first posture range R1 (FIG. 4(*a*)) stored beforehand. When it is determined that the values do not fall within the predetermined first value range, the procedure proceeds to step 13. When it is determined that the values fall within the predetermined first value range, the procedure proceeds to step 14.

(Step 13)

Figure 7:
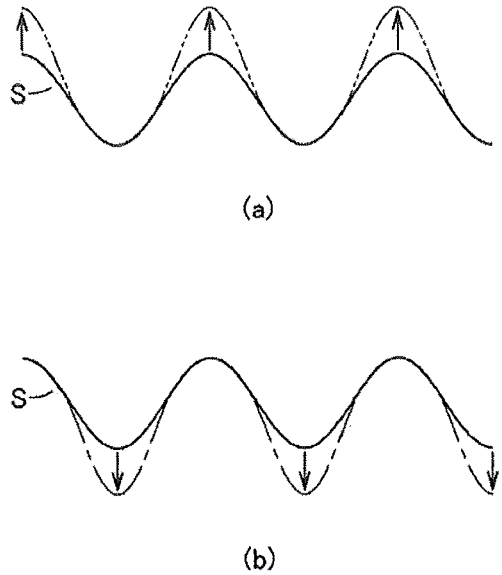
FIGS. 7(*a*) and 7(*b*) are each an explanatory diagram showing an electrical signal for shifting the vibration position of the work device, the electrical signal being generated by the controller in the automatic vibration mode.
Figure 8:
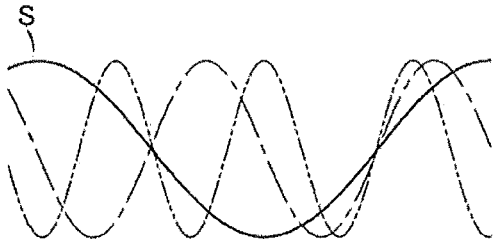
FIG. 8 is an explanatory diagram showing an electrical signal for setting the vibration speed of the work device, the electrical signal being generated by the controller in the automatic vibration mode.

The controller 37 relatively shifts the position of the stick 13*st* (vibration center) by offsetting the electrical signal S to be output to the solenoid proportional valves 38*st*, 39*st* by a predetermined amount (FIG. 7(*a*) or FIG. 7(*b*)), and then returns to step 12. For example, FIG. 7(*a*) shows the electrical signal that shifts the position of the stick 13*st* upward, and FIG. 7(*b*) shows the electrical signal that shifts the position of the stick 13*st* downward.

(Step 14)

The controller 37 determines whether or not an instruction to stop the automatic vibration mode is input through the operation of either one of the switches 25, 27. When it is determined that the instruction to stop the automatic vibration mode is not input, the procedure proceeds to step 11. When it is determined that the instruction to stop the automatic vibration mode is input, the automatic vibration mode is ended.

(Step 15)

The controller 37 compares the weight of the load measured by the weight sensor 16 with a third threshold value stored beforehand. The third threshold value may or may not be equal to the first threshold value described above. When the weight of the load is equal to or greater than the third threshold value, the procedure proceeds to step 16. When the weight of the load is less than the third threshold value, the procedure proceeds to step 17.

(Step 16)

The controller 37 sets the amplitude of the automatic vibration at a predetermined, large third amplitude, and moves the procedure to step 19.

(Step 17)

The controller 37 compares the weight of the load measured by the weight sensor 16 with a fourth threshold value stored beforehand, which is smaller than the third threshold value. The fourth threshold value may or may not be equal to the second threshold value described above. When it is determined that the weight of the load is equal to or greater than the fourth threshold value, the procedure proceeds to step 18. When it is determined that the weight of the load is less than the fourth threshold value, the automatic vibration mode is ended.

(Step 18)

The controller 37 sets the amplitude of the automatic vibration at a predetermined, small fourth amplitude that is smaller than the third amplitude set in step 16, and then moves the procedure to step 19.

(Step 19)

The controller 37 generates an electrical signal S, which simulates an electrical signal generated by the operator operating the operation levers 23 when repeatedly executing the bucket-in/out operation, outputs the electrical signal S to the solenoid proportional valves 38*bk*, 39*bk*, and thereby executes the bucket-in/out operation at the set amplitude. Accordingly, the second automatic vibration mode is executed.

(Step 20)

The controller 37 measures the positions of the boom 13*bm*, the stick 13*st*, and the bucket 13*bk* by means of the posture sensor 15, and determines whether the values obtained by the posture sensor 15 fall within a predetermined second value range corresponding to the predetermined second posture range R2 (FIG. 4(*b*)) stored beforehand. When it is determined that the values do not fall within the predetermined second value range, the procedure proceeds to step 21. When it is determined that the values fall within the predetermined second value range, the procedure proceeds to step 22.

(Step 21)

The controller 37 shifts the position of the bucket 13*bk* by offsetting the electrical signal S to be output to the solenoid proportional valves 38*bk*, 39*bk* by a predetermined amount, and then returns to step 20.

(Step 22)

The controller 37 determines whether or not an instruction to stop the automatic vibration mode is input through the operation of either one of the switches 25, 27. When it is determined that the instruction to stop the automatic vibration mode is not input, the procedure proceeds to step 19. When it is determined that the instruction to stop the automatic vibration mode is input, the automatic vibration mode is ended.

It should be noted that the vibration positions in the respective automatic vibration modes can be changed to fall within the respective posture ranges by, for example, allowing the operator to manually perform a wheel operation of the switch 25 or operate the operation levers 23.

Similarly, the amplitudes in the respective automatic vibration modes can variably be set at desired amplitudes by, for example, allowing the operator to perform a wheel operation of the switch 25 or input desired amplitudes into the monitor 29.

The vibration speeds (vibration cycles) in the respective automatic vibration modes can be variably set at desired amplitudes by, for example, allowing the operator to perform a wheel operation of the switch 25 or operation of input into the monitor 29. In so doing, the controller 37 variably sets the vibration cycle of the automatic vibration of the electrical signal S (FIG. 8) and outputs it. In this case, finer adjustments can be made to the automatic vibration.

The effects of the foregoing embodiment are described next.

Being provided with the posture sensor 15 for detecting the posture of the work device 13 can accomplish sieving by causing the work device 13 to automatically vibrate while having the position of the work device 13 fed back. Therefore, the ranges of the automatic vibration or the centers of the amplitudes of the automatic vibration can automatically be corrected any time to obtain a stable state of the chassis 11 without spilling the load. Consequently, the work device 13 can automatically be vibrated (sieving) in a posture suitable for the automatic vibration (sieving). Thus, the load spilling out of the bucket 13*bk* can be prevented from coming into contact with the cab 20.

In the automatic vibration mode, the automatic vibration is started after the work device 13 is brought to the predetermined preparation posture, realizing the automatic vibration (sieving) in an ideal posture.

Being provided with the weight sensor 16 for detecting the weight of the load scooped into the bucket 13*bk* can accomplish feedback of the weight of the load to change the amplitude or speed of the automatic vibration (sieving) of the work device 13 in accordance with the weight of the load.

Note, in the foregoing embodiment, that the amplitudes corresponding to the weights of loads in the respective automatic vibration modes are broken into two, large and small types; however, the amplitudes may be broken into finer types.

Although the automatic vibration mode is switched between the first automatic vibration mode and the second automatic vibration mode by means of the switches 25, 27, the automatic vibration mode may have only either one of the modes.

INDUSTRIAL APPLICABILITY

The present invention is suitable for a hydraulic shovel type work machine. However, as long as the work device protrudes from the chassis, the present invention can also be employed in a wheel type work machine.

The invention claimed is:

1. An automatic vibration device for a work machine, the automatic vibration device comprising:

a chassis;

a work device coupled to the chassis so that the work device may be operated relative to the chassis, the work device including a stick rotated by a stick cylinder, and a bucket coupled axially to a tip of the stick and rotated by a bucket cylinder;

a posture sensor configured to generate a posture signal that is indicative of a posture of the work device;

a weight sensor configured to generate a weight signal that is indicative of a weight of a load scooped into the bucket; and a controller operatively coupled to the stick cylinder, the bucket cylinder, the posture sensor, and the weight sensor, the controller being configured to effect an automatic vibration mode that causes the work device to vibrate automatically, receive the posture signal from the posture sensor, maintain the posture of the work device within a predetermined posture range while automatically vibrating the work device, based on the posture signal, receive the weight signal from the weight sensor, compare the weight of the load to a first weight threshold value, and set an amplitude of an automatic vibration of the work device to a first amplitude value in response to the weight of the load being not less than the first weight threshold value.

2. The automatic vibration device of claim 1, wherein the controller is further configured to compare the weight of the load to a second weight threshold value, and set the amplitude of the automatic vibration of the work device to a second amplitude value in response to the weight of the load being less than the first weight threshold value and not less than the second weight threshold value.

3. The automatic vibration device of claim 2, wherein the second weight threshold value is less than the first weight threshold value, and the second amplitude value is less than the first amplitude value.

4. The automatic vibration device of claim 1, wherein the automatic vibration mode is a first automatic vibration mode achieved by oscillatory operation of the stick cylinder, and the controller is further configured to effect a second automatic vibration mode achieved by oscillatory operation of the bucket cylinder.

5. The automatic vibration device of claim 4, wherein the controller is further configured to selectively effect one of the first automatic vibration mode and the second automatic vibration mode based on a position of a vibration mode switch.

6. The automatic vibration device of claim 4, wherein the controller is further configured to compare the weight of the load to a second weight threshold value, and set an amplitude of the automatic vibration of the work device during the second automatic vibration mode to a second amplitude value in response to the weight of the load being not less than the second weight threshold value.

7. The automatic vibration device of claim 6, wherein the controller is further configured to compare the weight of the load to a third weight threshold value, and set the amplitude of the automatic vibration of the work device during the second automatic vibration mode to a third amplitude value in response to the weight of the load being less than the second weight threshold value and not less than the third weight threshold value.

8. The automatic vibration device of claim 7, wherein the third weight threshold value is less than the second weight threshold value, and the third amplitude value is less than the second amplitude value.

* * * * *